US005515250A

United States Patent [19]

Ortega

[11] Patent Number: 5,515,250

[45] Date of Patent: May 7, 1996

[54] MAGNETIC VALE SPRING SHIM REMOVER

[76] Inventor: Joe A. Ortega, 1303 Galindo St., Concord, Calif. 94520

[21] Appl. No.: 520,025

[22] Filed: Aug. 28, 1995

[51] Int. Cl.[6] ..... B25B 23/18

[52] U.S. Cl. ..... 362/119; 29/221.6; 81/488

[58] Field of Search ..... 29/215, 221.6, 29/229, 266; 362/109, 119, 120; 81/488

[56] References Cited

U.S. PATENT DOCUMENTS

| | | | |
|---|---|---|---|
| 2,515,292 | 7/1950 | Carr | 362/119 X |
| 4,372,023 | 2/1983 | Castoe | 29/266 X |
| 4,446,608 | 5/1984 | Johnson | 29/215 X |

*Primary Examiner*—Stephen F. Husar

*Attorney, Agent, or Firm*—Bielen, Peterson & Lampe

[57] ABSTRACT

A device for removing valve spring shims from automotive cylinder heads, the device being constructed in the form of a hand tool having a pair of prongs at the end of a shaft, with a magnet installed in each prong.

10 Claims, 1 Drawing Sheet

MAGNETIC VALE SPRING SHIM REMOVER

BACKGROUND OF THE INVENTION

This invention relates to a specialty hand tool to assist in the repair and maintenance of valves located inside an automobile engine. The valve condition directly affects engine efficiency, and each of the components in the valve assembly is subject to different types of wear. Mechanics must often completely disassemble the valve assembly in order to inspect and either recondition or replace worn or broken components.

As part of the disassembly process small metallic washers, customarily called valve spring shims must be removed and inspected. Valve spring shims are inserted into valve assemblies under the valve springs in order to maintain a specified compression of the valve springs that is necessary for proper engine operation. The valve spring shims are usually difficult to remove because the shims are located in a well in the engine head and occasionally in the engine block. The combination of pressure from the spring and gumming from contaminated oil affixes them to the valve spring seat. Compounding the problem, in many of newer engine designs the valve spring seat is deeply recessed into the engine head, making removal of even a loosened valve spring shim more difficult. Engine mechanics often waste valuable service time attempting to unstick and remove the valve spring shims using conventional tools such as screwdrivers or long tweezers.

It is an object of this invention to provide an inexpensive hand tool to quickly and easily extract a valve spring shim from the recessed well in which that valve spring shim is located. It is a further object of this invention to provide a tool that will remove a valve spring shim from a recessed well having a projecting valve stem guide around which the valve spring shim is seated.

SUMMARY OF THE INVENTION

This invention relates to a device for assisting a mechanic in servicing the valve assembly of internal combustion engines, in particular, vehicle engines of automobiles, trucks and the like. The device is preferably in the form of an inexpensive, specialty hand tool that utilizes a pair of displaced magnets at the end of a shaft to magnetically attach to the valve spring shim, allowing the shim to be lifted up over the projecting valve shaft guide. The displaced magnets are installed in the ends of a pair of prongs on the end of the tool shaft allowing the magnets to span the projecting guide and attach to the washer-like shim on each side of the guide. This spacing of the magnets prevents the shim from canting and jamming between the wall of the well and valve guide.

Preferably, the tool is fabricated from an inexpensive plastic in an injection molding process with cylindrical magnet plugs press-fit into molded or machined holes in the prongs of the tool. The molded valve shim tool integrates a flat handle with the pronged shaft. This arrangement permits convenient manipulation of the tool during the retrieval process, which often must be performed with the aid of a light. Although a pen light is incorporated into the shaft of one embodiment of the tool, it is preferred that the tool be as inexpensive to fabricate as possible for a wide distribution to general service stations. Specialty valve shops that would frequently use the valve shim tool may however, appreciate the added light feature.

Although the valve shim tool may be made with more than two tine elements, or with a cylindrical cup-like head with an annular magnet around the circumference of the end, the two-prong tool is preferred to maximize visibility during removal.

The valve shim tool solves the problem of removing the valve spring shims, thus lowering engine service labor time. These and other features will become apparent from a consideration of the Detailed Description of the Preferred Embodiments.

DETAILED DESCRIPTION OF THE PREFERRED EMBODIMENTS

Figure 1:
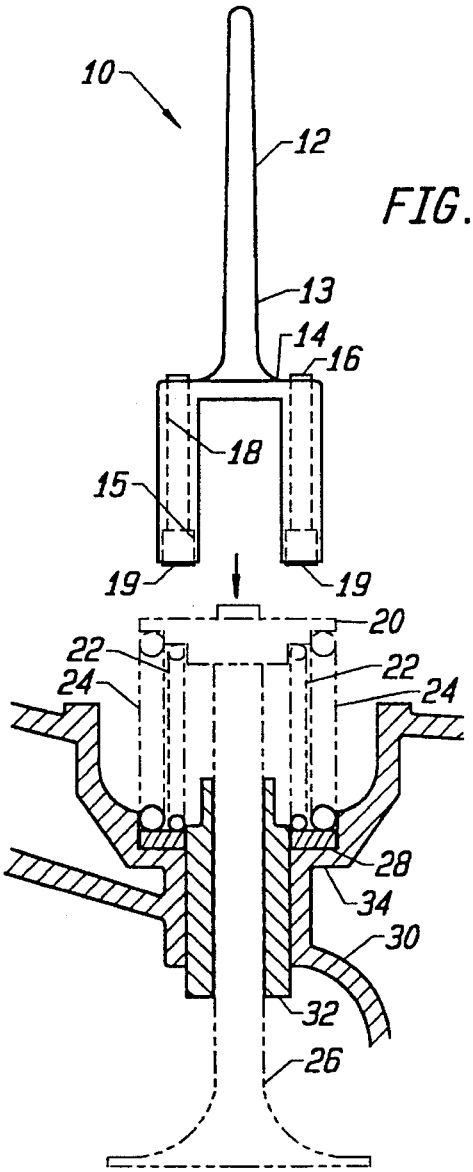
FIG. 1 is an enlarged side view of the valve shim tool and a typical valve assembly well of an engine head with the removed valve spring and valve shown in phantom. The valve shim tool is shown prior to its insertion into the valve recess to retrieve the valve spring shim.

Referring to FIG. 1, the valve shim tool, designated generally by the reference numeral 10, is shown utilizing the concepts of this invention. The valve shim tool 10 is constructed with a nonmagnetic handle 12, a non-metallic head 14 and two spaced magnetic tine elements 16.

The non-metallic, tapered handle 12 and non-metallic head 14 are preferably manufactured as a one-piece molding. The handle 12 provides the grip utilized by the mechanic to operate the valve shim tool 10. The non-metallic head 14 consists of a flat block of non-metallic material having two prong members 17 forming a 'U' shape with the closed end located at the base of the head 14. In this embodiment the shaft 13 is integral with the handle 12. A hole 18, shown in dotted line, is bored into the center of each prong member 17, having a diameter slightly smaller than the diameter of the magnetic tine elements 16. The end 15 of each opposing hole 18 is then reamed a short distance along the longitudinal axis of the prong member 17 at a diameter equal or slightly greater than the diameter of the magnetic tine elements 16. Each magnetic tine element 16 is then inserted into the hole 18 from the enlarged end 15 and press-fit into place, thus ensuring a snug fit inside the non-metallic head 14. Two open magnetic face elements 19 are flush with, or project slightly from the end of the valve shim tool.

The valve spring shim removal process is described with reference to FIGS. 1 and 2. The process is accomplished by first removing the valve spring seat, the inner valve spring 22, the outer valve spring 24, and the valve 26. The valve spring shim 28 is located in the well 29 formed between the engine head 30 and the valve guide 32.

The valve shim tool 10 is then inserted head first into the recess formed between the engine head 30 and the valve guide 32 in such a manner as to create physical contact between each magnetic face element 19 and the valve spring shim 28. The magnetic tine elements 16 are constructed of a sufficient magnetic strength as to attach to the valve spring shim 28 and overcome any resistance provided by the customary accumulation of oil and debris which tend to keep the valve spring shim 28 stuck to the valve spring seat 34. A stuck shim 28 can first be loosened with a screw driver or other probe.

Once physical contact between the magnetic face elements 19 and the valve spring shim 28 is made, the mechanic may merely remove the tool 10 from the engine head and then separate the valve spring shim 28 from the magnetic face elements 19.

Figure 2:
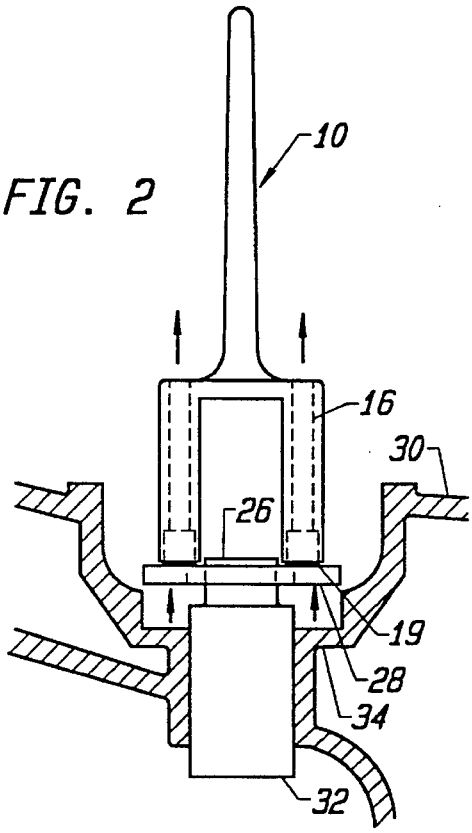
FIG. 2 is an enlarged side view of the valve shim tool of FIG. 1 after it has engaged the valve spring shim and is being withdrawn from the well of the engine head.

A side view of the valve shim tool is shown in FIG. 2, midway through the removal process. The valve spring shim 28 is magnetically attached to the magnetic face elements 19 and is being pulled in the upward direction away from the valve guide 26 and the valve spring seat 34.

In the preferred embodiment the non-metallic head 14 is manufactured using a low permeability material, thereby decreasing the magnetic field perpendicular to the longitudinal axis of the valve shim tool. Under this construction the valve shim tool is less likely to attach itself to the sides of a ferrous engine head as it is inserted towards the valve spring shim 28.

Figure 3:
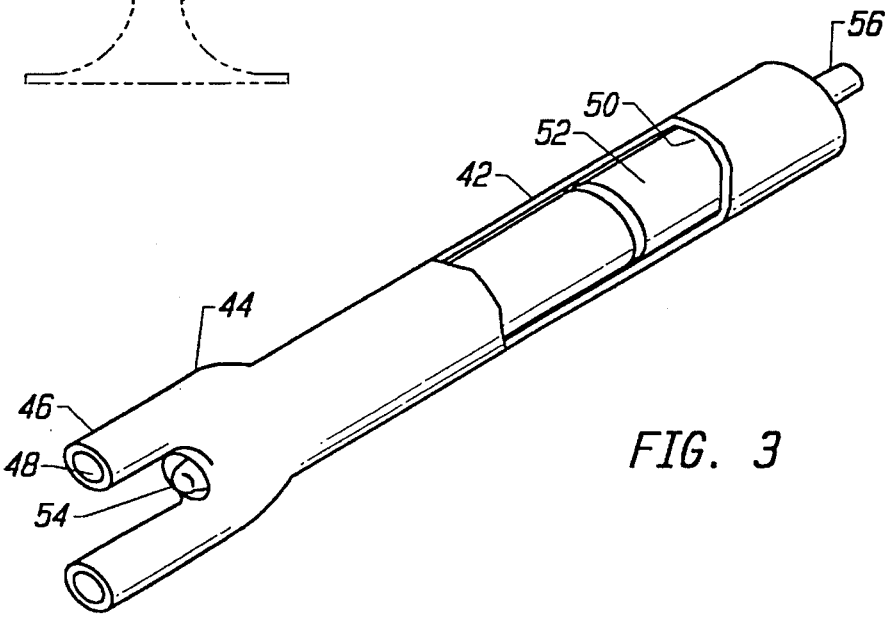
FIG. 3 is a perspective view of an alternate embodiment of a valve shim tool.

Referring to the perspective FIG. 3, an alternate embodiment of the a valve shim tool 40 is shown. The tool 40 has an elongated shaft 42 with a head 44 and a pair of prong members 46 with magnetic tine elements 48, similar to the tool 10 of FIG. 1. The handle 42 is hollow with a battery cavity 50 having a pair of small AAA batteries 52 and a light 54 with a switch button 56. The light 54 is positioned between the prong members 46 for efficient projection of light into the engine recess where the valve shim is seated.

What is claimed is:

1. A device adapted to remove the valve spring shim of a valve assembly in internal combustion engines, the device comprising:

a hand tool having a handle and connected shaft with a pronged end, the pronged end having at least two tine elements with terminal ends, the terminal ends each having a magnet, wherein the tine elements are spaced to span a projecting valve guide in a valve assembly and permit engagement of the magnets with the shim.

2. The device of claim 1 wherein the handle and connected shaft are a continuous member.

3. The device of claim 1 wherein the pronged end forms a cylindrical head, wherein the head is constructed using a material of low magnetic permeability.

4. The device of claim 1 wherein the shaft contains an illumination means for illuminating the space located between the opposing magnetic tines.

5. The device of claim 4 wherein the illumination means comprises a light positioned between the tine elements, and a power source for the light, wherein the power source is contained in the handle.

6. A device for removing valve spring shims from an engine, comprising:

a non-magnetic handle having a longitudinal axis;

a non-magnetic two-pronged head having a longitudinal axis coincident with the axis of the handle; and two opposed magnetic tines projecting from the pronged head and parallel to the longitudinal axis of the pronged head.

7. The device of claim 6 wherein the handle and pronged head comprise a single unitary molded structure.

8. The device of claim 6 wherein the cylindrical head is constructed using a material of low magnetic permeability.

9. The device of claim 6 wherein the handle contains an illumination means for illuminating the space located between the opposed magnetic tines.

10. The device of claim 9 wherein the illumination means comprises a light in the pronged head between the opposed magnetic tines, and a power source in the handle.

* * * * *